US011101058B2

(12) United States Patent
Saito et al.

(10) Patent No.: US 11,101,058 B2
(45) Date of Patent: Aug. 24, 2021

(54) COMPACT, ELECTROMAGNETIC COMPONENT, AND METHOD FOR PRODUCING COMPACT

(71) Applicants: Sumitomo Electric Industries, Ltd., Osaka (JP); SUMITOMO ELECTRIC SINTERED ALLOY, LTD., Takahashi (JP)

(72) Inventors: Tatsuya Saito, Itami (JP); Hijiri Tsuruta, Itami (JP); Asako Watanabe, Itami (JP); Tomoyuki Ueno, Itami (JP)

(73) Assignees: Sumitomo Electric Industries, Ltd., Osaka (JP); Sumitomo Electric Sintered Alloy, Ltd., Takahashi (JP)

( * ) Notice: Subject to any disclaimer, the term of this patent is extended or adjusted under 35 U.S.C. 154(b) by 542 days.

(21) Appl. No.: 15/765,767

(22) PCT Filed: Oct. 24, 2016

(86) PCT No.: PCT/JP2016/081412
§ 371 (c)(1),
(2) Date: Apr. 4, 2018

(87) PCT Pub. No.: WO2017/082027
PCT Pub. Date: May 18, 2017

(65) Prior Publication Data

US 2018/0294085 A1 Oct. 11, 2018

(30) Foreign Application Priority Data

Nov. 10, 2015 (JP) ..... JP2015-220076

(51) Int. Cl.
*H01F 1/34* (2006.01)
*H01F 27/255* (2006.01)
(Continued)

(52) U.S. Cl.
CPC ..... *H01F 1/344* (2013.01); *B22F 1/0059* (2013.01); *B22F 3/02* (2013.01); *B22F 3/24* (2013.01);
(Continued)

(58) Field of Classification Search
None
See application file for complete search history.

(56) References Cited

U.S. PATENT DOCUMENTS 10,207,323 B2 * 2/2019 Matsutani ..... H01F 1/14791
2011/0101262 A1 5/2011 Kuroda et al.
(Continued)

FOREIGN PATENT DOCUMENTS

CN 102049516 A 5/2011
JP 2012-084803 A 4/2012
(Continued)

*Primary Examiner* — Kevin M Bernatz
(74) *Attorney, Agent, or Firm* — Baker Botts L.L.P.; Michael A. Sartori

(57) ABSTRACT

A compact is provided. When the compact is used for a magnetic core, a magnetic path cross section has a cross-sectional perimeter of more than 20 mm, and at least part of a surface of the compact is covered with an iron-based oxide film having an average thickness of 0.5 μm or more and 10.0 μm or less. Letting the proportion of the surface area of the compact to the volume of the compact be surface area/volume, the content of $Fe_3O_4$ present in the iron-based oxide film with respect to 100% by volume of the compact satisfies any one of (1) to (3): (1) less than 0.085% by volume when the (surface area/volume) is 0.40 $mm^{-1}$ or less, (2) 0.12% or less by volume when the (surface area/volume) is more than 0.40 $mm^{-1}$ and 0.60 $mm^{-1}$ or less, and (3) 0.15% or less by volume when the (surface area/volume) is more than 0.60 $mm^{-1}$.

7 Claims, 2 Drawing Sheets

(51) Int. Cl.

| | |
|---|---|
| ***H01F 41/02*** | (2006.01) |
| ***H01F 1/24*** | (2006.01) |
| ***H01F 1/33*** | (2006.01) |
| ***B22F 3/02*** | (2006.01) |
| ***C22C 33/02*** | (2006.01) |
| ***B22F 1/00*** | (2006.01) |
| ***H01F 3/08*** | (2006.01) |
| ***H01F 3/10*** | (2006.01) |
| ***B22F 3/24*** | (2006.01) |
| ***H01F 27/28*** | (2006.01) |
| *B22F 3/10* | (2006.01) |
| *B22F 1/02* | (2006.01) |
| *H01F 37/00* | (2006.01) |

(52) U.S. Cl.

CPC ..... *H01F 1/24* (2013.01); *H01F 1/33* (2013.01); *H01F 3/08* (2013.01); *H01F 3/10* (2013.01); *H01F 27/255* (2013.01); *H01F 27/28* (2013.01); *H01F 41/02* (2013.01); *H01F 41/0246* (2013.01); *B22F 1/02* (2013.01); *B22F 3/1021* (2013.01); *B22F 2003/023* (2013.01); *B22F 2003/248* (2013.01); *B22F 2201/03* (2013.01); *B22F 2201/50* (2013.01); *B22F 2301/35* (2013.01); *B22F 2302/25* (2013.01); *B22F 2998/10* (2013.01); *B22F 2999/00* (2013.01); *C22C 33/02* (2013.01); *C22C 2202/02* (2013.01); *H01F 37/00* (2013.01); *H01F 2003/106* (2013.01)

(56) References Cited

U.S. PATENT DOCUMENTS

| | | | | |
|---|---|---|---|---|
| 2012/0038449 | A1* | 2/2012 | Ogawa | H01F 17/0033 336/221 |
| 2012/0188049 | A1* | 7/2012 | Matsuura | H01F 1/24 336/212 |
| 2012/0229244 | A1* | 9/2012 | Ueno | H01F 41/0246 336/221 |
| 2013/0322135 | A1 | 12/2013 | Kusawake et al. | |
| 2014/0104023 | A1* | 4/2014 | Yang | B22F 1/02 335/297 |
| 2016/0307679 | A1* | 10/2016 | Taheri | B22F 1/0011 |
| 2017/0025214 | A1* | 1/2017 | Nishimura | H01F 27/255 |
| 2018/0374619 | A1* | 12/2018 | Orimo | H01F 1/342 |
| 2019/0013127 | A1* | 1/2019 | Maede | H01F 3/08 |
| 2019/0322135 | A1* | 10/2019 | Taylor | B60B 17/00 |
| 2020/0222986 | A1* | 7/2020 | Katoh | B22F 3/24 |
| 2021/0104342 | A1* | 4/2021 | Taheri | H01F 1/26 |

FOREIGN PATENT DOCUMENTS

| | | | |
|---|---|---|---|
| JP | 2012-199513 | A | 10/2012 |
| JP | 2012-243912 | A | 12/2012 |
| JP | 2013-62457 | A | 4/2013 |

* cited by examiner

COMPACT, ELECTROMAGNETIC COMPONENT, AND METHOD FOR PRODUCING COMPACT

TECHNICAL FIELD

The present disclosure relates to a compact, an electromagnetic component, and a method for producing a compact. The present application claims priority to Japanese Patent Application No. 2015-220076 filed in the Japan Patent Office on Nov. 10, 2015, which is hereby incorporated by reference herein in its entirety. The contents of Japanese Unexamined Patent Application Publication No. 2012-243912 are incorporated by reference into the present application.

BACKGROUND ART

One of magnetic cores for electromagnetic components and so forth is a compact in which a soft-magnetic powder is compacted into a predetermined shape (for example, PTL 1).

CITATION LIST

Patent Literature

PTL 1: Japanese Unexamined Patent Application Publication No. 2012-243912

SUMMARY OF INVENTION

A compact according to the present disclosure includes coated soft-magnetic particles collected, the coated soft-magnetic particles including iron-based particles and insulating coatings that cover surfaces of the iron-based particles. When the compact is used for a magnetic core, a magnetic path cross section has a cross-sectional perimeter of more than 20 mm. At least part of a surface of the compact is covered with an iron-based oxide film having an average thickness of 0.5 μm or more and 10.0 μm or less. Letting the proportion of the surface area of the compact to the volume of the compact be surface area/volume, the content of $Fe_3O_4$ present in the iron-based oxide film with respect to 100% by volume of the compact satisfies any one of (1) to (3):

(1) the content of $Fe_3O_4$ is less than 0.085% by volume when the (surface area/volume) is 0.40 $mm^{-1}$ or less;

(2) the content of $Fe_3O_4$ is 0.12% by volume or less when the (surface area/volume) is more than 0.40 $mm^{-1}$ and 0.60 $mm^{-1}$ or less; and (3) the content of $Fe_3O_4$ is 0.15% by volume or less when the (surface area/volume) is more than 0.60 $mm^{-1}$.

A method for producing a compact according to the present disclosure includes the steps of compacting a raw-material powder including a coated soft-magnetic powder and a lubricant to form a green compact, the coated soft-magnetic powder including iron-based particles and insulating coatings that cover surfaces of the iron-based particles; and heat-treating the green compact to form a compact in which when the compact is used for a magnetic core, a magnetic path cross section has a cross-sectional perimeter of more than 20 mm. The lubricant contains a component having a decomposition onset temperature of 170° C. or higher, and the content of the lubricant is 0.10% or more by mass and 0.60% or less by mass based on 100% by mass of the raw-material powder. Conditions of the heat treatment include an oxygen concentration in an atmosphere of 0.01% or more by volume and 5.0% or less by volume and a temperature of higher than 520° C. and 700° C. or lower.

DESCRIPTION OF EMBODIMENTS

Figure 1:
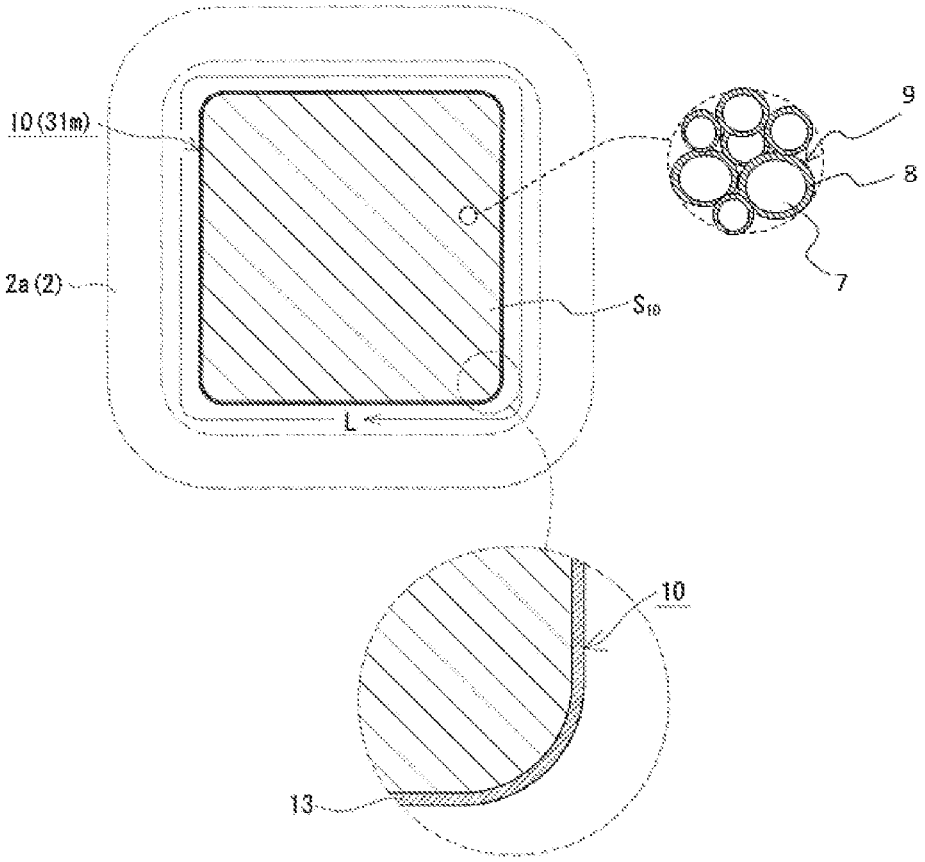
FIG. 1 is a schematic cross-sectional view of a compact according to an embodiment.

PTL 1 discloses that a raw-material powder including a coated iron powder having insulating coatings and a lubricant is compacted, the resulting green compact is heat-treated in a nitrogen atmosphere, and a slide-contact surface of the green compact with a die set is subjected to acid treatment to provide a low-loss compact having, in particular, reduced eddy-current loss and thus low iron loss, which is the sum of hysteresis loss and eddy-current loss. The heat treatment after the compacting contributes to a reduction in hysteresis loss. The use of the coated powder as a raw-material powder together with the use of the lubricant contributes to a reduction in eddy-current loss. In particular, as described in PTL 1, an electrically conductive portion, which is formed by the plastic deformation of the metal powder particles at the time of removal from the die set, between the metal powder particles formed on the slide-contact surface with the dies, is cut off by the acid treatment in which immersion in concentrated hydrochloric acid is performed, thereby further reducing eddy-current loss and iron loss. However, because the acid treatment is needed in addition to the heat treatment, the number of steps is large; thus, it is desirable to improve the productivity. If masking treatment or the like is performed before the acid treatment in order to subject only a specific portion of the compact to the acid treatment without damaging a good insulating coating, the number of steps is further increased. If the acid treatment is omitted, it is difficult to sufficiently reduce the eddy-current loss, as described in test examples below.

When the foregoing heat treatment after the compressing is performed in an air atmosphere instead of the nitrogen atmosphere (hereinafter, also referred to as a "case of air treatment"), the eddy-current loss can be reduced, compared with the case where heat treatment after compressing is performed in a nitrogen atmosphere and where no acid treatment is performed after the heat treatment (hereinafter, also referred to as a "case of nitrogen treatment only"), as described in the test examples below. However, the iron loss in the case of air treatment is higher than the iron loss in the case of performing the acid treatment after the heat treatment in the nitrogen atmosphere (hereinafter, the case of performing both of the nitrogen treatment and the acid treatment is also referred to as a "case of nitrogen treatment+acid treatment"). Thus, the compact desirably has low iron loss without performing acid treatment or the like after the heat treatment of the compact, specifically has iron loss lower than the case of nitrogen treatment only, preferably has iron loss lower than the case of air treatment, more preferably has iron loss comparable to, even more preferably lower than the case of nitrogen treatment+acid treatment.

A compact according to the present disclosure includes coated soft-magnetic particles collected, the coated soft-magnetic particles including iron-based particles and insulating coatings that cover surfaces of the iron-based particles. When the compact is used for a magnetic core, a magnetic path cross section has a cross-sectional perimeter of more than 20 mm. At least part of a surface of the compact is covered with an iron-based oxide film having an average thickness of 0.5 μm or more and 10.0 μm or less. Letting the proportion of the surface area of the compact to the volume of the compact be surface area/volume, the content of $Fe_3O_4$ present in the iron-based oxide film with respect to 100% by volume of the compact satisfies any one of (1) to (3):

(1) the content of $Fe_3O_4$ is less than 0.085% by volume when the surface area/volume is 0.40 $mm^{-1}$ or less;

(2) the content of $Fe_3O_4$ is 0.12% by volume or less when the surface area/volume is more than 0.40 $mm^{-1}$ and 0.60 $mm^{-1}$ or less; and (3) the content of $Fe_3O_4$ is 0.15% by volume or less when the surface area/volume is more than 0.60 $mm^{-1}$.

When the compact is used for a magnetic core of an electromagnetic component, the compact can provide a low-loss magnetic core having iron loss lower than the case of nitrogen treatment only, preferably iron loss lower than the case of air treatment, more preferably iron loss comparable to, even more preferably lower than the case of nitrogen treatment+acid treatment, for reasons described below. The compact can be produced by, for example, compacting a raw-material powder mainly formed of a coated powder including iron-based particles having insulating coatings on surfaces thereof and then subjecting the resulting green compact to heat treatment under specific conditions (see a method for producing a compact described below). Acid treatment after the heat treatment can be omitted; thus, the compact also has good productivity.

(A) Eddy-Current Loss can be Reduced

The magnetic path cross section of the compact has a cross-sectional perimeter of more than 20 mm; thus, the size of the compact is such that a relatively long eddy-current loop depending on the cross-sectional perimeter is easily formed. The compact is liable to have high eddy-current loss because of its size; however, in the compact, the iron-based particles are electrically insulated mainly by the insulating coatings. Furthermore, the iron-based particles that form at least part of a surface of the compact, in particular, at least part of a slide-contact surface, on which an electrically conductive portion is liable to be formed at the time of removal from the die set, with the die set are electrically insulated from each other by the iron-based oxide film having higher electrical insulation than the iron-based particles. The surface insulation of the compact is increased by the insulating coatings and the iron-based oxide film. The compact has a low content of $Fe_3O_4$, which has a sufficiently higher resistivity than the iron-based particles and which has a relatively low resistivity as an insulating material. The content of $Fe_3O_4$ satisfies a specific range, depending on the surface area/volume. As described in the test examples, comparisons between compacts having the same size and density indicate that the compact basically has a lower content of $Fe_3O_4$ than the case of air treatment, preferably has a lower content of $Fe_3O_4$ than the case of nitrogen treatment+acid treatment, depending on production conditions. Thus, the compact can have reduced eddy-current loss.

(B) An Increase in Hysteresis Loss can be Inhibited, Preferably the Hysteresis Loss can be Reduced Even in the case where the compact contains $Fe_3O_4$, which is a ferromagnetic material and has a higher coercive force than pure iron, in the iron-based oxide film, the content thereof is within a specific range and tends to be lower than the case of an air atmosphere. Thus, the compact can inhibit an increase in hysteresis loss due to the presence of $Fe_3O_4$ and can have hysteresis loss comparable to or lower than the case of air treatment. In particular, a smaller (surface area/volume) results in a lower content of $Fe_3O_4$ in the compact. Thus, an increase in hysteresis loss due to the presence of an excess of $Fe_3O_4$ on the surface of the compact is inhibited.

The compact according to an embodiment has a cross-sectional perimeter of 40 mm or more and a (surface area/volume) of 0.60 $mm^{-1}$ or less.

Although the compact according to the embodiment has a size that is liable to lead to a longer eddy-current loop, depending on the cross-sectional perimeter, a low-loss magnetic core can be formed because of a specific amount of $Fe_3O_4$ in addition to good insulation resulting from the insulating coatings and the iron-based oxide film as described above.

The compact according to an embodiment has surfaces entirely covered with the iron-based oxide film having a thickness of 0.5 μm or more and 10.0 μm or less at any point.

The compact according to the embodiment has only small variations in the thickness of the iron-based oxide film. The iron-based oxide film is uniformly present on the surfaces of the compact and satisfactorily insulates the iron-based particles, which form the surfaces of the compact, from each other. Thus, the compact according to the embodiment has higher surface insulation, so that the eddy-current loss is easily reduced. Furthermore, an increase in hysteresis loss due to the local presence of a thick portion can be inhibited, thereby resulting in a magnetic core having lower loss. In the embodiment, masking treatment or the like for the formation of the iron-based oxide film on only a specific portion is not required, thus resulting in better productivity.

The compact according to an embodiment has a relative density of 90.0% or more and 99.0% or less.

The compact according to the embodiment has a high density and only a few pores. The green compact in the production process also has a high density. An excess of the iron-based oxide film is less likely to be formed during the heat treatment. $Fe_3O_4$ can thus be appropriately contained. In this embodiment, because the density is not excessively high, there is no need for the application of a very high compaction pressure during the production process, thus easily preventing damage due to an excessive compaction pressure and providing a good insulating coating. Therefore, the compact according to this embodiment can provide a magnetic core having lower loss.

An electromagnetic component according to the present disclosure includes a coil and a magnetic core on which the coil is arranged, in which at least part of the magnetic core includes any one of the compacts described above.

The electromagnetic component is low loss because at least part, preferably the whole of the magnetic core is formed of the compact. Because the compact has good productivity, the electromagnetic component also has good productivity.

A method for producing a compact according to the present disclosure includes a compaction step and a heat-treatment step as described below.

(Compaction step) A step of compacting a raw-material powder that includes a coated soft-magnetic powder and a lubricant to form a green compact, the coated soft-magnetic powder including iron-based particles and insulating coatings that cover surfaces of the iron-based particles.

(Heat-treatment step) A step of heat-treating the green compact to form a compact in which when the compact is used for a magnetic core, a magnetic path cross section has a cross-sectional perimeter of more than 20 mm.

The lubricant contains a component having a decomposition onset temperature of 170° C. or higher, and the content of the lubricant is 0.10% or more by mass and 0.60% or less by mass based on 100% by mass of the raw-material powder.

Conditions of the heat treatment include an oxygen concentration in an atmosphere of 0.01% or more by volume and 5.0% or less by volume and a temperature of higher than 520° C. and 700° C. or lower.

According to the method for producing a compact, a compact that can provide a low-loss magnetic core is formed for reasons described below. Furthermore, according to the method for producing a compact, the low-loss compact can be produced without performing post-treatment, such as acid treatment, after the heat treatment.

(A) Eddy-Current Loss can be Reduced

The reasons for this are as follows: Because the coated soft-magnetic powder is used, a compact in which the insulating coatings are interposed between the iron-based particles is formed. Because a specific lubricant is used, damage to the insulating coatings due to the rubbing of the coated powder particles against each other during compacting or the like is easily prevented. Because the heat treatment temperature is not excessively high, thermal damage to the insulating coatings can be inhibited. Because the heat treatment of the green compact is performed at a specific temperature in a specific low-oxygen atmosphere, Fe in the iron-based particles included in the green compact is bonded to oxygen in the atmosphere to form an iron-based oxide, thereby producing the compact in which at least part of a surface of the green compact is covered with the iron-based oxide film. The iron-based oxide film is also interposed between the iron-based particles located at a portion of the green compact where the insulating coatings are peeled to expose the iron-based particles, typically at least part of a slide-contact surface of the green compact with the die set, thereby insulating the iron-based particles from each other. Because the heat treatment is performed under the specific conditions, $Fe_3O_4$, which has a relatively low resistivity, is not excessively formed as described above, and the content can be in the specific range (see the foregoing compact). From these points, the compact having good insulation is formed.

(B) An Increase in Hysteresis Loss can be Inhibited, Preferably the Hysteresis Loss can be Reduced The reasons for this are as follows: Because the oxygen concentration in the low-oxygen atmosphere is in the specific range, $Fe_3O_4$, which is a ferromagnetic material, is not excessively formed. Thus, the content of $Fe_3O_4$ can be in the specific range as described above. Because the heat-treatment temperature is relatively high, thermal damage to the insulating coatings can be prevented while strain introduced into the iron-based particles during the compaction step can be sufficiently removed.

Details of Embodiments of Invention

Details of embodiments will be described below. A compact according to an embodiment, an electromagnetic component, and a method for producing a compact will be described in that order.

[1. Compact]

Figure 2:
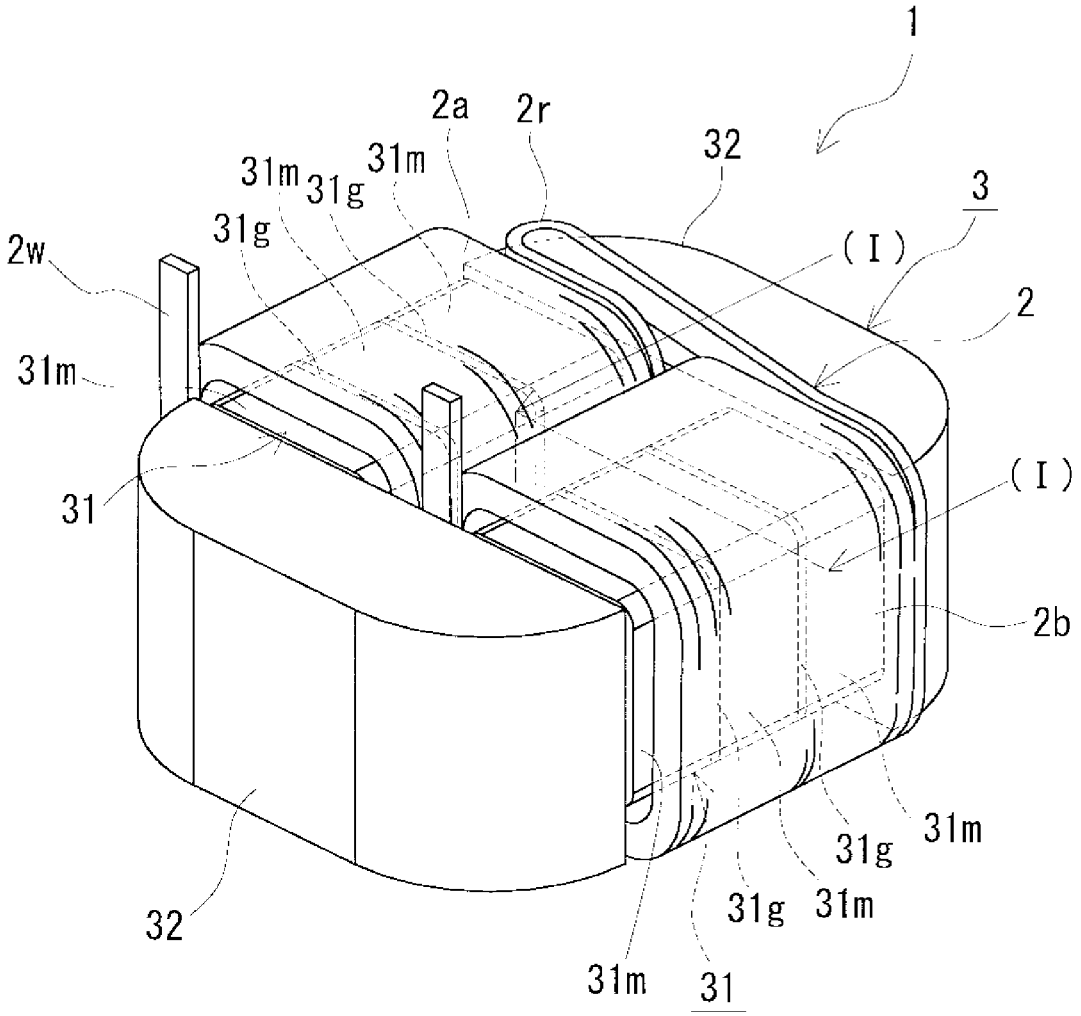
FIG. 2 is a schematic perspective view of an example of an electromagnetic component according to an embodiment.

A compact 10 according to an embodiment will be described with reference to FIGS. 1 and 2. FIG. 1 is a cross-sectional view taken along cutting plane line (I)-(I) of FIG. 2 (plane orthogonal to magnetic flux). The compact 10 is mainly formed of a soft-magnetic powder and is produced by compacting a raw-material powder mainly formed of the soft-magnetic powder into a predetermined shape and then performing heat treatment. The compact 10 is used for at least part of a magnetic core 3 included in an electromagnetic component 1 as illustrated in FIG. 2 to form a magnetic path. FIG. 2 illustrates the case where the compacts 10 (core pieces 31*m* and 32) are combined together to form a ring-shaped closed magnetic circuit. The compact 10 can have various shapes (see Section Electromagnetic Component described below).

The compact 10 of the embodiment is formed of coated soft-magnetic particles collected, the coated soft-magnetic particles including iron-based particles 7 and insulating coatings 8 that cover surfaces of the iron-based particles 7. When the compact 10 is used for the magnetic core 3, the cross-sectional perimeter L of a magnetic path cross section $S_{10}$ (hatched area in FIG. 1) is relatively long. The compact 10 of the embodiment includes an iron-based oxide film 13 having a specific thickness, the iron-based oxide film 13 serving as a coating layer that covers at least part of its surface. The content of a specific component ($Fe_3O_4$) in the iron-based oxide film 13 is in a specific range. The size of the compact 10 is such that the cross-sectional perimeter L is relatively long; however, because the compact 10 includes the insulating coatings and the iron-based oxide film 13 and has a low content of $Fe_3O_4$, the low-loss magnetic core 3 can be formed. The compact 10 will be described in more detail below.

[1.-1 Coated Soft-Magnetic Particles]

[1.-1-1 Iron-Based Particles]

The iron-based particles 7 included in coated soft-magnetic particles 9 are composed of an iron-based material mainly containing Fe. Examples of the iron-based material include pure iron (having a purity of 99% or more by mass, the balance being incidental impurities), and iron-based alloys having an Fe content of more than 50% by mass. Examples of the iron-based alloys include Fe—Si—Al-based alloys, Fe—Si-based alloys, and Fe—Al-based alloys. In particular, the pure iron is preferred for the following reasons: The pure iron has high magnetic permeability and high magnetic flux density. The pure iron has good plastic deformability, so that the density and strength of the compact 10 are easily increased. Because of its high purity, the hysteresis loss can be reduced.

[1.-1-2 Insulating Coatings]

The insulating coatings 8 included in the coated soft-magnetic particles 9 are interposed between the iron-based particles 7 to increase the insulation, contributing to a reduction in eddy-current loss. Examples of the insulating material of the insulating coatings 8 are described below. The insulating coatings 8 may have a single-layer structure or a multilayer structure including different insulating materials.

(1) Metal element-containing compounds: for example, metal oxides, metal nitrides, and metal carbides containing at least one metal element selected from, for example, Fe, Al, Ca, Mn, Zn, Mg, V, Cr, Y, Ba, Sr, and rare-earth elements (excluding Y) and at least one or more of oxygen, nitrogen, and carbon, and zirconium compounds and aluminum compounds.

(2) Non-metal element-containing compounds: for example, phosphorus compounds and silicon compounds.

(3) Metal salt compounds: for example, metal phosphates (typically, iron phosphate, manganese phosphate, zinc phosphate, calcium phosphate, and so forth), metal phosphate compounds, silicon phosphate compounds, and metal titanate compounds.

(4) Resins: polyamide-based resins (for example, nylon 6, nylon 66), and silicone resins.

(5) Salts of higher fatty acids.

A metal phosphate compound such as iron phosphate has good adhesion to iron and good deformability and follows the deformation of the iron-based particles 7 to deform during compacting; thus, the metal phosphate compound is not easily damaged. Accordingly, the compact 10 has the good insulating coatings 8; thus, an eddy current is easily reduced.

The insulating coatings 8 have an average thickness of, for example, 10 nm or more and 1 μm or less. An average thickness of 10 nm or more results in good insulation between the iron-based particles 7. An average thickness of 1 μm or less does not result in an excessive amount of the insulating coatings 8 to inhibit a decrease in the percentage of a magnetic component in the compact 10 due to an excess of the insulating coatings 8, thereby providing desired magnetic properties. The lower limit of the thickness (the total thickness in the case of the multilayer structure) may be 20 nm or more, 50 nm or more, or 100 nm. The upper limit may be 500 nm or less, 300 nm or less, or 250 nm or less. The average thickness depends on the thickness of the insulating coatings 8 of the coated powder used as a raw material and tends to be substantially equal thereto. Thus, the thickness of the insulating coatings 8 may be adjusted to a desired value in a state of being a raw material. Regarding the measurement of the average thickness, paragraph [0041] in the specification of PTL 1 can be referenced.

[1.-1-3 Size]

The coated soft-magnetic particles 9 included in the compact 10 have an average particle size of, for example, 50 μm or more and 400 μm or less. An average particle size of 50 μm or more easily results in the compact 10 having a high density. An average particle size of 400 μm or less results in the compact 10 that can be used for the formation of the low-loss magnetic core 3 that easily provides low eddy-current loss. The average particle size may be 50 μm or more and 150 μm or less, 50 μm or more and less than 100 μm, or 50 μm or more and 80 μm or less. The average particle size depends on the size of the coated powder used as a raw material and tends to be substantially equal thereto. Thus, the average particle size may be adjusted to a desired value in a state of being a raw material. The average particle size is determined by, for example, observing a cross section of the compact 10 with a scanning electron microscope, analyzing the observed image with commercially available image analysis software to extract each particle, defining the circle-equivalent diameter of each particle as a particle diameter, and averaging the particle diameters of 1,000 or more particles.

[1.-2 Other Components Contained]

The compact 10 is mainly formed of the coated soft-magnetic particles 9 (90% or more by mass based on 100% of the compact 10). The compact 10 may further contain a lubricant and an additive used during compacting, denatured materials caused by heat treatment thereof, and pores; however, smaller amounts of these materials and pores easily result in the compact 10 having higher density and thus are preferred.

[1.-3 Cross-Sectional Perimeter]

The compact 10 has a cross-sectional perimeter L of more than 20 mm, as one of the features thereof. The cross-sectional perimeter L is the length of a contour surrounding a cross section taken along a plane orthogonal to magnetic flux when the compact 10 is used for the magnetic core 3. The cross-sectional perimeter L is equal to the perimeter of the outer periphery of the compact 10 parallel to the magnetic flux. In the compact 10 (core pieces 31*m*) having a rectangular parallelepiped-like shape as illustrated in FIGS. 1 and 2, because the magnetic path cross section $S_{10}$ has a rectangle-like shape (FIG. 1), the cross-sectional perimeter L is equal to the total length of the contour of the rectangle.

If the iron-based particles 7 included in a surface of the magnetic core 3 arranged parallel to the magnetic flux are in contact with each other and in a conduction state, an eddy-current loop is formed, depending on the cross-sectional perimeter L, thus easily increasing the eddy-current loss. In the compact 10 having a relatively long cross-sectional perimeter L, the eddy-current loss is easily increased in terms of size; however, because the compact 10 is formed of the coated soft-magnetic particles 9 and includes a specific amount of the specific iron-based oxide film 13, the eddy-current loss can be reduced. A longer cross-sectional perimeter L more easily results in the effect of reducing the eddy-current loss. The compact 10 may have a cross-sectional perimeter L of 30 mm or more, 35 mm or more, or 40 mm or more. When the compact 10 has a cross-sectional perimeter L of 45 mm or more, 50 mm or more, or 100 mm or more as described in test examples below, the effect of reducing the eddy-current loss is more easily provided. The upper limit of the cross-sectional perimeter L is, for example, 300 mm or less, 250 mm or less, or 200 mm or less in view of the production of the compact 10.

[1.-4 Coating Layer]

The compact 10 includes the iron-based oxide film 13 that covers at least part of its surface as one of the features thereof. The iron-based oxide contained in the iron-based oxide film 13 has higher electrical insulation than the iron-based particles 7. The presence of the iron-based oxide on a surface of the compact 10 increases the insulation of the surface. The iron-based oxide is interposed between, in particular, the iron-based particles 7 to increase insulation between the iron-based particles 7 and breaks an eddy-current path through the iron-based particles 7.

[1.-4-1 Region Present]

From the viewpoint of breaking the eddy-current path, a region where the iron-based oxide film 13 is present preferably contains at least part of the outer periphery of the compact 10 parallel to the magnetic flux when the compact 10 is used for the magnetic core 3. In particular, the region is preferably arranged so as to break an eddy-current loop in the circumferential direction of the outer periphery. For example, the compact 10 having a rectangular parallelepiped-like shape illustrated in FIG. 2 includes the iron-based oxide film 13 extending from one end face orthogonal to the magnetic flux to the other end face opposite the one end face. The presence of the breaking region on the outer periphery shortens the eddy-current loop that can be generated on a surface of the compact 10. Specifically, the length of the eddy-current loop can be less than the cross-sectional perimeter L to reduce the eddy-current loss. The arrangement of the iron-based oxide film 13 that covers substantially the entire outer periphery can sufficiently reduce an eddy current that flows the outer periphery to further reduce the eddy-current loss. The arrangement of the iron-based oxide film 13 that covers substantially all surfaces of the compact 10 can more effectively reduce the eddy current to further reduce the eddy-current loss. In this case, good productivity is also provided.

[1.4-2 Content of $Fe_3O_4$]

Letting the proportion of the surface area of the compact 10 to the volume of the compact 10 be surface area/volume, the iron-based oxide film 13 has a content of $Fe_3O_4$ (triiron tetraoxide, magnetite) in a specific range, depending on the (surface area/volume) of the compact 10, as one of the features thereof. $Fe_3O_4$ has a higher resistivity than the iron-based particles 7 and is interposed between the iron-based particles 7 to increase the insulation between the iron-based particles 7, thereby reducing the eddy-current loss. However, because $Fe_3O_4$ has a relatively low resistivity as an insulating material, a high content of $Fe_3O_4$ leads to an increase in eddy-current loss. Furthermore, the incorporation of $Fe_3O_4$, which is a ferromagnetic material and has a higher coercive force than pure iron, leads to an increase in hysteresis loss. Consequently, the incorporation of $Fe_3O_4$ can lead to an increase in iron loss. It was, however, found that, as described in test examples below, in the case where the content of $Fe_3O_4$ in the entire compact 10 is in a specific range, virtually no increase in eddy-current loss or hysteresis loss is caused by the incorporation of $Fe_3O_4$, and the eddy-current loss and the hysteresis loss can be reduced, depending on the content. It was also found that when the (surface area/volume) is lower, the eddy-current loss is more susceptible to the effect of the content of $Fe_3O_4$. Based on the findings, the content of $Fe_3O_4$ in the compact 10 is specified as described below, depending on the (surface area/volume). The content of $Fe_3O_4$ described below is a percentage based on 100% of the volume of the compact 10.

(1) The content of $Fe_3O_4$ is less than 0.085% by volume when the (surface area/volume) is 0.40 $mm^{-1}$ or less.

(2) The content of $Fe_3O_4$ is 0.12% or less by volume when the (surface area/volume) is more than 0.40 $mm^{-1}$ and 0.60 $mm^{-1}$ or less.

(3) The content of $Fe_3O_4$ is 0.15% or less by volume when the (surface area/volume) is more than 0.60 $mm^{-1}$.

In any case of (1) to (3), even when the iron-based oxide film 13 contains $Fe_3O_4$, the content of $Fe_3O_4$ in the compact 10 is in a specific range; thus, the low-loss magnetic core 3 capable of reducing the eddy-current loss and inhibiting an increase in hysteresis loss can be formed. In any case of (1) to (3), a higher content of $Fe_3O_4$ more easily results in an increase in hysteresis loss, and a certain content of $Fe_3O_4$ also easily results in an increase in eddy-current loss; thus, a lower content of $Fe_3O_4$ is preferred. Accordingly, in any case of (1) to (3), the content of $Fe_3O_4$ contains 0% by volume. Even if $Fe_3O_4$ is contained (even at a content of $Fe_3O_4$ higher than 0% by volume), as described in the test examples below, when the content $Fe_3O_4$ is in a specific range, the content $Fe_3O_4$ more preferably satisfies a range described below from the viewpoint of achieving low iron loss.

(1) The case where the (surface area/volume) is 0.40 $mm^{-1}$ or less 0.005% or more by volume and 0.08% or less by volume, 0.005% or more by volume and 0.075% or less by volume, 0.01% or more by volume and 0.07% or less by volume, 0.01% or more by volume and less than 0.067% by volume, 0.01% or more by volume and 0.06% or less by volume, 0.01% or more by volume and 0.05% or less by volume, or 0.01% or more by volume and 0.045% or less by volume (2) The case where the (surface area/volume) is more than 0.40 $mm^{-1}$ and 0.60 $mm^{-1}$ or less 0.01% or more by volume and 0.10% or less by volume, 0.015% or more by volume and 0.095% or less by volume, 0.02% or more by volume and 0.09% or less by volume, or 0.02% or more by volume and 0.08% or less by volume, (3) The case where the (surface area/volume) is more than 0.60 $mm^{-}$ 0.03% or more by volume and 0.145% or less by volume, 0.035% or more by volume and 0.14% or less by volume, 0.04% or more by volume and 0.13% or less by volume, or 0.04% or more by volume and 0.1% or less by volume In particular, the compacts 10 having a cross-sectional perimeter L of 40 mm or more and a (surface area/volume) of 0.60 $mm^{-1}$ or less according to (1) and (2) have a longer cross-sectional perimeter L and are liable to lead to an increase in eddy-current loss; thus, a lower content of $Fe_3O_4$, which has a relatively low resistivity as an insulating material, is preferred, and the iron-based oxide film 13 preferably has a smaller thickness.

The iron-based oxide film 13 may be substantially composed of $Fe_3O_4$. In addition, the iron-based oxide film 13 may contain an iron oxide other than $Fe_3O_4$, such as $\alpha$-$Fe_2O_3$, $\gamma$-$Fe_2O_3$, or FeO, or an oxide containing an element in the insulating coatings 8, such as $Fe_2SiO_4$ or $Fe_2PO_5$. From the viewpoint of reducing iron loss, a lower content of $Fe_3O_4$ is preferred. Furthermore, preferably, no $Fe_3O_4$ is contained. In contrast, when $Fe_3O_4$ is contained within the range described above, strength and corrosion resistance should be improved, and the compact 10 can have high strength and good corrosion resistance. Accordingly, the total content of iron oxides other than $Fe_3O_4$ may be 0% or more by mass and 100% or less by mass or 95% or less by mass based on 100% by mass of the iron-based oxide film 13.

[1.-4-3 Thickness]

The iron-based oxide film 13 has an average thickness of 0.5 μm or more and 10.0 μm or less as one of the features thereof. An average thickness of 0.5 μm or more results in a sufficient presence of the iron-based oxide film 13 having good insulation as described above, thereby successfully providing the effect of the arrangement of the iron-based oxide film 13 on a reduction in eddy-current loss. Because a larger average thickness more easily results in the effect of reducing the eddy-current loss, the average thickness may be 0.6 μm or more, 0.7 μm or more, or 1.0 μm or more. An average thickness of 10.0 μm or less easily results in a low content of $Fe_3O_4$, thereby successfully providing the effect of inhibiting increases in hysteresis loss and eddy-current loss due to an excess of $Fe_3O_4$. A smaller average thickness more easily results in the effect. Thus, the average thickness may be 9.0 μm or less, 8.0 μm or less, 7.5 μm or less, or 7.0 μm or less.

When the thickness of a freely-selected point of the iron-based oxide film 13 is 0.5 μm or more and 10.0 μm or less, the iron-based oxide film 13 having only small variations in thickness and having a uniform thickness is present on a surface of the compact 10 is present. The arrangement of the iron-based oxide film 13 successfully provides the effect of reducing the eddy-current loss and the effect of inhibiting an increase in, for example, hysteresis loss due to an excess of $Fe_3O_4$ incorporated. In particular, when all the surfaces of the compact 10 are entirely covered with the iron-based oxide film 13, the iron-based oxide film 13 preferably has only small variations in thickness as described above. The thickness may be 0.55 μm or more and 9.0 μm or less, or 0.6 μm or more and 8.0 μm or less.

To set the content of $Fe_3O_4$, the thickness of the iron-based oxide film 13, and so forth to the specific ranges, for example, production conditions (compaction pressure (density of the green compact), and oxygen concentration in an atmosphere, temperature, time, and so forth during heat treatment) are adjusted.

[1.-5 Relative Density]

When the compact 10 has a relative density of 90.0% or more, the compact 10 sufficiently contains the iron-based particles 7, is dense, and has a high density and good magnetic properties. The green compact also has a high density. It is possible to form the compact 10 while inhibiting the excessive formation of $Fe_3O_4$, the compact 10 being capable of providing the low-loss magnetic core 3 including the iron-based oxide film 13. A higher relative density results in a denser compact, and the excessive formation of $Fe_3O_4$ during the production process is easily inhibited. Thus, the relative density may be 91.0% or more, 92.0% or more, 92.5% or more, or 93.0% or more. When the relative density is 99.0% or less, there is no need to excessively increase the compaction pressure during the production process. This can inhibit the damage of the insulating coatings 8 attributed to the excessive rubbing of the coated powder particles against each other due to an excessive load of the compaction pressure, thereby forming the compact 10 having the good insulating coatings 8 and good insulation. From the viewpoint of preventing the damage of the insulating coatings 8, the relative density may be 98.5% or less, 98.0% or less, or 97.5% or less.

The compact 10 can provide the low-loss magnetic core 3. The compact 10 has good productivity because it can be produced by specific heat treatment without performing acid treatment after the heat treatment. These effects will be specifically described in the test examples below.

[2. Electromagnetic Component]

The electromagnetic component 1 according to an embodiment will be described with reference to FIG. 2. The electromagnetic component 1 includes a coil 2 formed of a wound wire 2*w* and the magnetic core 3 on which the coil 2 is arranged. In particular, the electromagnetic component 1 according to an embodiment includes the compact 10 according to an embodiment, the compact 10 serving as at least part of the magnetic core 3. Examples of the electromagnetic component 1 include reactors, transformers, motors, choke coils, antennae, fuel injectors, and ignition coils.

An example of the wound wire 2*w* is a coated wire including a conductor with an insulating layer arranged on its outer periphery. Examples of the conductor include wires such as round wires and rectangular wires composed of conductive materials copper, copper alloys, aluminum, and aluminum alloys. Examples of a material of the insulating layer include enamel, tetrafluoroethylene-hexafluoropropylene copolymer (FEP) resins, polytetrafluoroethylene (PTFE) resins, and silicone rubber. A known wound wire may be used as the wound wire 2*w*.

The electromagnetic component 1 illustrated in FIG. 2 is a reactor including the coil 2 including a pair of cylindrically wound portions 2*a* and 2*b* connected with a connecting portion 2*r*, and the ring-shaped magnetic core 3 including a pair of inner core portions 31 and 31 on which the wound portions 2*a* and 2*b* are arranged and a pair of outer core portions 32 and 32 on which the coil 2 is not arranged, the outer core portions 32 and 32 protruding from the coil 2. Each of the inner core portions 31 and 31 includes the rectangular parallelepiped-like core pieces 31*m* mainly composed of a soft magnetic material, and gap materials 31*g* arranged between adjacent core pieces 31*m* and 31*m*, the gap materials 31*g* having lower relative permeability than the core pieces 31*m*. The outer core portions 32 are formed of columnar core pieces mainly composed of a soft magnetic material. Among these core pieces 31*m* and 32, at least one core piece is formed of the compact 10. In the magnetic core 3 according to this embodiment, all the core pieces are formed of the compacts 10 and are low-loss components. This results in the low-loss electromagnetic component 1 (reactor in this embodiment).

Examples of the form of the magnetic core 3 include a combined form (this embodiment) in which core pieces are combined together and a single form consisting of only a single core piece. Examples of the shape of each core piece in the combined form include E-shapes, I-shapes (rod shapes), T-shapes, and [-shapes. Examples of the single form include ring-shaped bodies and C-shaped bodies each formed in one piece. The core pieces formed of the compacts 10 having a desired shape can be formed with a die set having a desired shape.

Examples of the combined form include a form in which all core pieces are formed of the compacts 10 (this embodiment); and a form including a core piece other than the compact 10, for example, a multilayer core formed of magnetic steel sheets or a composite material core containing a soft magnetic powder and a resin. Another example thereof is a form including air gaps instead of the gap materials 31*g*. In the single form, for example, a form that does not include a magnetic gap may be used.

[3. Method for Producing Compact]

A method for producing a compact according to an embodiment includes a compaction step of compacting a raw-material powder to form a green compact, and a heat-treatment step of heat-treating the green compact to form a compact. In particular, in this production method, the compact having a specific size is produced with a specific raw-material powder, the heat treatment is performed under specific conditions, and acid treatment or the like is not performed after the heat treatment. According to the method for producing a compact according to an embodiment, the compact that can provide a low-loss magnetic core can be produced with good productivity through a small number of steps.

Each step will be described in detail below.

[3.-1 Compaction Step]

In this step, the raw-material powder prepared is fed into the die set having a predetermined shape, compacted, and removed from the die set, thereby providing the green compact. The use of the raw-material powder including the coated soft-magnetic powder and a lubricant is one of the features, the soft-magnetic powder including the iron-based particles 7 composed of an iron-based material described in the foregoing section of the iron-based particles 7 and the insulating coatings 8 that cover the surfaces of the iron-based particles 7.

[3.-1-1 Preparation of Raw-Material Powder]

[Coated Powder]

The coated soft-magnetic powder is produced by forming the insulating coatings 8 on the surfaces of the iron-based particles 7 with the insulating material or the like described in the foregoing section of the insulating coatings 8. For the purposes of producing the iron-based particles 7 (iron-based powder) and forming the insulating coatings 8, known methods may be employed. A commercially available coated powder may also be used. The insulating coatings 8 in the state of a raw material are denatured during the heat treatment and are different in terms of a constituent material from the insulating coatings 8 included in the compact 10 after the heat treatment, in some cases. The material of the insulating coatings 8 in the state of the raw material may be selected in such a manner that the constituent material of the insulating coatings 8 after the heat treatment is a desired material.

[Lubricant]

The incorporation of the lubricant in the raw-material powder reduces, for example, the rubbing of the coated powder particles against each other during compaction and the rubbing of the coated powder particles against the die set during removal from the die set, thus reducing the damage of the insulating coatings 8. In particular, the incorporation of a lubricant having a decomposition onset temperature of 170° C. or higher in air easily inhibits the excessive oxidation of the green compact during the heat treatment, thus easily providing the compact 10 including the iron-based oxide film 13 having a specific content of $Fe_3O_4$. When an atmosphere gas enters voids formed by removal of the lubricant through, for example, vaporization thereof due to the heating of the green compact during the heat treatment, internal oxidation proceeds. A high decomposition onset temperature results in the formation of the voids at a sufficiently high temperature, thereby inhibiting the progress of the internal oxidation. The incorporation of the lubricant having a decomposition onset temperature of 180° C. or higher, 190° C. or higher, or 200° C. or higher more easily inhibits the progress of the internal oxidation. At an excessively high decomposition onset temperature, the lubricant is difficult to remove during the heat treatment. Thus, the lubricant preferably has a decomposition onset temperature of 500° C. or lower, 475° C. or lower, or 450° C. or lower. Examples of the lubricant include ethylenebis(stearamide), stearamide, oleamide, palmitamide, behenamide, erucamide, zinc stearate, lithium stearate, calcium stearate, magnesium stearate, sodium stearate, and aluminum stearate. A lubricant other than these compounds listed above, for example, a metal soap, a fatty acid amide, a higher fatty acid, an inorganic substance, or a metal salt of a higher fatty acid, may be contained. The decomposition onset temperature of the lubricant can be changed, depending on an atmosphere during the heat treatment. In the method for producing a compact according to an embodiment, the atmosphere during the heat treatment is a specific low-oxygen atmosphere having a lower oxygen concentration than air (details will be described below). The decomposition onset temperature in air tends to be generally lower than the decomposition onset temperature in the low-oxygen atmosphere. Here, the decomposition onset temperature in air is used.

The total content of the lubricant including the lubricant having a decomposition onset temperature of 170° C. or higher is 0.10% or more by mass and 0.60% or less by mass based on 100% by mass of the raw-material powder. At a total content of 0.10% or more by mass, the incorporation of the lubricant in the raw-material powder successfully provides the effect of inhibiting damage to the insulating coatings 8. A higher total content more easily provides the effect of inhibiting damage to the insulating coatings 8. Thus, the total content may be 0.15% or more by mass, 0.20% or more by mass, or 0.30% or more by mass. At a total content of 0.60% or less by mass, decreases in density and the percentage of the magnetic component due to an excessive incorporation of the lubricant, the extension of the removal time, and so forth can be reduced, thus easily forming a high-density green compact with high productivity. When the total content is 0.55% or less by mass, 0.50% or less by mass, or 0.45% or less by mass, the high-density green compact sufficiently containing the magnetic component is easily formed while the damage of the insulating coatings 8 is successfully inhibited. When the total content is in the specific range described above, the progress of the internal oxidation is easily inhibited.

[3.-1-2 Compaction]

The shape and size of the cavity of the die set may be selected in such a manner that the green compact having a desired shape (the compact 10 after the heat treatment) is formed. Here, in particular, the green compact (compact 10) such that when the compact is used for the magnetic core 3, the cross-sectional perimeter L of the magnetic path cross section $S_{10}$ is more than 20 mm is formed.

The compaction pressure may be appropriately selected, depending on the shape, size, density, and so forth of the green compact. For example, the compaction pressure is about 300 MPa or more and about 2,000 MPa or less. At a higher compaction pressure, densification proceeds more easily. At a lower compaction pressure, the damage of the insulating coatings 8 is easily inhibited. The compaction pressure may be 400 MPa or more and 1,800 MPa or less, or 500 MPa or more and 1,700 MPa or less.

Preferably, the raw-material powder is preferably mixed with the lubricant, the lubricant being uniformly dispersed therein.

The lubricant may be applied to a portion of the die set coming into contact with the raw-material powder and the green compact. An example of the atmosphere during compaction is an air atmosphere. An example of the die-set temperature during compaction is normal temperature (for example, about 20° C.). Because the die-set temperature can be increased by processing heat, the die-set temperature may be appropriately adjusted.

[3.-2 Heat-Treatment Step]

In this step, the green compact formed in the compaction step is subjected to heat treatment to remove strain introduced into the iron-based particles 7 during compaction. Furthermore, Fe in the iron-based particles 7 of the green compact is bonded to oxygen in the atmosphere to form the iron-based oxide film on at least part of a surface of the green compact. The lubricant is removed as described above.

In particular, the use of specific conditions such that the content of $Fe_3O_4$ in the iron-based oxide film is in a specific range and such that the iron-based oxide film has a specific thickness (see the foregoing section "Compact") is one of the features. Regarding the specific heat-treatment conditions, the atmosphere is a low-oxygen atmosphere having an oxygen concentration of 0.01% or more by volume and 5.0% or less by volume, and the heating temperature is higher than 520° C. and 700° C. or lower.

A region where the iron-based oxide film is formed preferably includes an electrically conductive portion of a surface of the green compact before the heat treatment, the electrically conductive portion being formed as follows: the iron-based particles 7 are plastically deformed, exposed from the insulating coatings 8, and come into contact with each other during removal from the die set. In the electrically conductive portion, Fe in the iron-based particles 7 easily come into contact with oxygen in the atmosphere and thus both are easily bonded together to from the iron-based oxide film. The formation of the iron-based oxide film can insulate the iron-based particles 7 from each other and contributes to a reduction in eddy-current loss. A portion of a surface of the green compact where the iron-based oxide film is not formed may be subjected to masking treatment in advance. In the case where the iron-based oxide film is entirely formed on all the surfaces of the green compact, the masking treatment is not required, thus providing better productivity.

The coated soft-magnetic particles 9 including the good insulating coatings 8 are, of course, present on a surface of the green compact. Because oxygen in the atmosphere can penetrate the insulating coatings 8, the iron-based oxide film can be formed on each side of each of the good insulating coatings 8. The iron-based oxide film can also be formed on the coated soft-magnetic particles 9 arranged inside the green compact with the use of the voids formed by removal of the lubricant as described above. Thus, the specific heat-treatment conditions are used so as to inhibit the excessive internal oxidation.

When the oxygen concentration in the atmosphere is 0.01% or more by volume based on 100% of the entire atmosphere, the iron-based oxide film having a content of $Fe_3O_4$ within a specific range can be formed. At a higher oxygen concentration, although $Fe_3O_4$ is more easily formed, the iron-based oxide film is easily thickened, so that the compact 10 surely including the iron-based oxide film and having good insulation can be produced. Thus, the oxygen concentration may be 0.015% or more by volume, or 0.02% or more by volume.

An oxygen concentration of 5.0% or less by volume results in the inhibition of excessive formation of $Fe_3O_4$ and the iron-based oxide film, thus producing the compact 10 appropriately including the iron-based oxide film. A lower oxygen concentration more easily results in the inhibition of excessive formation of $Fe_3O_4$ and the internal oxidation, thereby producing the compact 10 that can provide the low-loss magnetic core 3 having good magnetic properties. Thus, the oxygen concentration may be less than 5.0% by volume, 4.5% or less by volume, or less than 3.0% by volume. As described in the test examples below, it was found that at a very low oxygen concentration, specifically, at an oxygen concentration of less than 1.0% by volume, 0.9% or less by volume, 0.5% or less by volume, or 0.1% or less by volume, the iron-based oxide film having a significantly low content of $Fe_3O_4$ can be formed to reduce the eddy-current loss and the hysteresis loss. When the loss is intended to be further reduced, the oxygen concentration may be further reduced as described above. The oxygen concentration of the atmosphere may be adjusted so as to be set to a desired value within the specific range.

As the heat treatment, any of continuous treatment in which an object (here, the green compact) is continuously subjected to heat treatment and batch treatment in which a predetermined amount of object is subjected to heat treatment in one operation can be employed. The continuous treatment is suitable for industrial mass production. The batch treatment is suitable for the case where the loss is intended to be reduced by lowering the oxygen concentration because the atmosphere is controlled with high accuracy.

Test Example 1

Green compacts having various sizes were produced under various conditions using a coated soft-magnetic powder including the iron-based particles 7 and the insulating coatings 8 as a raw-material powder. The resulting green compacts were subjected to heat treatment under various conditions to produce compacts. The loss of the resulting compacts was studied.

In this test example, a powder mixture of a coated soft-magnetic powder (coated powder) including the two-layer insulating coatings 8 and a lubricant is used as the raw-material powder. The coated powder is produced as follows: A pure iron powder that is composed of pure iron (an Fe content of 99% or more by mass, the balance being incidental impurities) and that has an average particle size of 53 μm is prepared. The average particle size refers to 50% particle size (by mass) measured with a commercially available laser diffraction/scattering particle size distribution analyzer. An inner layer (thickness: about 100 nm) composed of iron phosphate is formed by phosphating treatment on the surface of each of the particles of the pure iron powder (iron-based particles 7), and then an outer layer (thickness: about 30 nm) mainly composed of Si and O (oxygen) is formed by chemical conversion treatment on the inner layer. Ethylenebis(stearamide) having a decomposition onset temperature of 215° C. in air is prepared as a lubricant. The content (% by mass) of the lubricant based on 100% by mass of the raw-material powder is listed in Tables 1 to 4.

In this test, columnar green compacts having a rectangular parallelepiped-like shape are formed for each sample and subjected to heat treatment to form compacts (core pieces). These compacts are assembled in a ring shape to form a ring-shaped magnetic core (see the magnetic core 3 illustrated in FIG. 2). In each of the compacts serving as portions of the magnetic core around which the coil is arranged (the inner core portions 31 of the magnetic core 3 illustrated in FIG. 2), a die set is selected in such a manner that the proportion of the surface area of the compact to the volume of the compact, i.e., (surface area/volume ($mm^{-1}$)), and the cross-sectional perimeter (mm) of the magnetic path cross section when the compact is used for the magnetic core are values listed in Tables 1 to 4, and then compaction is performed. Here, different (surface area/volume) values are obtained by changing the length of each side of the rectangular parallelepiped.

In this test, the compacts having different densities are formed by the use of different compaction pressures selected from the range of 700 MPa to 1,500 MPa. The use of a higher compaction pressure within the range described above forms the compact having a higher density. In this example, the compact having a relative density of 92.6% is formed at a compaction pressure of 981 MPa (≈9 ton/$cm^2$). In all the samples, the compaction is performed in an air atmosphere, and the die-set temperature is normal temperature.

The resulting green compacts of each sample are subjected to heat treatment at a temperature in an atmosphere listed in Tables 1 to 4. For all samples, the rate of temperature increase to the heat-treatment temperature is 5° C./min, the heat-treatment time is 15 minutes. In this test, the atmosphere is selected from a nitrogen atmosphere (atmosphere containing substantially no oxygen, oxygen concentration: less than 0.001% by volume), an air atmosphere (oxygen concentration: about 21% by volume), and a low-oxygen atmosphere (oxygen concentration: listed in Tables 1 to 4). The compacts of each sample are formed by the heat treatment, the compacts including the coated soft-magnetic particles 9 collected, the coated soft-magnetic particles 9 including the iron-based particles 7 and the insulating coatings 8. In the samples in which the atmosphere during the heat treatment is the air atmosphere or the low-oxygen atmosphere, the surfaces of each compact are entirely covered with a coated layer (here, an iron-based oxide film).

Regarding the samples in which the heat treatment has been performed in the nitrogen atmosphere, the heat-treated samples (hereinafter, referred to as a "heat-treated material") is subjected to acid treatment under conditions described below. The acid treatment is performed for a slide-contact surface of each green compact with the die set before the heat treatment. The samples that have been heat-treated in the air atmosphere or the low-oxygen atmosphere are not subjected to acid treatment (Conditions of Acid Treatment)

Part of a surface (slide-contact surface) of the heat-treated material is immersed in a tank containing concentrated hydrochloric acid having a pH of 1 and a temperature of 26° C. for 20 minutes while the concentrated hydrochloric acid is stirred. The width of a region of the heat-treated material that has been subjected to the acid treatment is 7% of the cross-sectional perimeter L. The height of the region that has been subjected to acid treatment is equal to the height of a plane parallel to the direction of magnetic flux when the compact is used for the magnetic core. A region of the heat-treated material that is not subjected to the acid treatment is masked. After the acid treatment, the target object is washed with water, and then the mask is removed.

Cross sections of the compacts of each sample were formed. The microscopic observation of the surface of the cross section of each compact indicated that each sample that had been subjected to the heat treatment in the air atmosphere or the low-oxygen atmosphere had a coating layer different from the insulating coatings 8. In particular, in the slide-contact portion of the surface of the compact with the die set, the coating layer was present in a portion where the insulating coatings 8 of the coated soft-magnetic particles 9 are peeled to expose the iron-based particles 7. In a portion other than the slide-contact portion, the coating layer was present on each side of each insulating coating 8. The quantitative analysis of a surface component of the surfaces of each compact of each sample by X-ray diffraction (XRD) indicated that the coating layer was composed of an oxide mainly containing Fe. Thus, the coating layer is seemingly formed by bonding between Fe of the iron-based particles 7 and oxygen in the atmosphere. Hereinafter, the coating layer is also referred to as an "iron-based oxide film".

Regarding each compact of each sample, the thickness (μm) of the coating layer (iron-based oxide film) and the percentage by volume (% by volume) of the coating layer (iron-based oxide film) with respect to the compact are listed in Tables 1 to 4. The thickness of the coating layer is determined as follows: Cross sections of the compacts of each sample are formed. Each cross section is observed with a laser microscope to measure the thickness of the coating layer in an observed image at freely-selected 100 points thereof. The average at the 100 points is described in Tables 1 to 4. The percentage by volume of the coating layer with respect to the compact is determined as follows: Given that the coating layer having a uniform thickness is present on all the surfaces of the compact, the volume of the coating layer is determined using the average thickness at the 100 points as the thickness of the coating layer. The volume of the coating layer is divided by the volume of the compact. Here, 10 fields of view were examined, and 10 measurement points were used for each field of view; thus, a total of 100 points were used. The coating layer at the measurement points includes the insulating coating 8, in some cases. Here, because the insulating coating 8 is sufficiently thin, the thickness including the insulating coating 8 is measured as the thickness of the coating layer.

For each compact of each sample, the percentage by volume (% by volume) of $Fe_3O_4$ with respect to the compact is determined using the quantitative analysis of the surface component by X-ray diffraction. The results are listed in Tables 1 to 4. In the case where a peak assigned to $Fe_3O_4$ is observed from the results of X-ray diffraction, the percentage by volume of $Fe_3O_4$ with respect to the volume of the coating layer is determined. By using this result and the foregoing percentage by volume of the coating layer, the content of $Fe_3O_4$ (% by volume) in the compact is determined.

The relative density (%) of each compact of each sample is measured, and the results are listed in Tables 1 to 4. The relative density is a value obtained by dividing the actual density of the compact by a true density. The actual density is determined by measuring the volume of the compact using the Archimedes method and dividing the mass of the compact by the measured volume. The true density is determined by, for example, the use of a measuring device such as a pycnometer or by calculation from a composition determined by component analysis. Alternatively, the true density of the raw-material powder is used.

For the compacts of the samples, the hysteresis loss, the eddy-current loss, and the iron loss (the sum of the hysteresis loss and the eddy-current loss) are determined as described below, and the results are listed in Tables 1 to 4. In this test, the compacts are assembled into a ring-shaped magnetic core for each sample. A primary winding coil (72 turns) and a secondary winding coil (20 turns), which are formed by winding a copper wire, are arranged on the magnetic core, thereby providing a measurement member. The hysteresis loss and the eddy-current loss at an excited magnetic flux density Bm of 0.1 T (=1 kG) and a measurement frequency of 10 kHz are determined with the measurement member and an AC-BH curve tracer (BHU-60, available from Riken Denshi Co., Ltd). For the samples that had been subjected to the heat treatment in the nitrogen atmosphere, the loss of both the compacts that were not subjected to the acid treatment after the heat treatment and the compacts that were subjected to the acid treatment after the heat treatment was determined. In this test, each of the iron loss, the hysteresis loss, and the eddy-current loss of a reference sample is defined as 100%. Relative values based on the reference sample are listed in Tables 1 to 4. A smaller relative value indicates a higher loss reduction effect.

TABLE 1

| | Heat-treatment conditions | | | Compact | | | Coating layer (iron-based oxide film) | | | | Loss | | |
|---|---|---|---|---|---|---|---|---|---|---|---|---|---|
| Sample No. | Raw-material powder Lubricant % by mass | Temperature ° C. | Oxygen concentration in atmosphere % by volume | Relative density % | Surface area/volume $mm^{-1}$ | Cross-sectional perimeter mm | Thickness μm | Percentage of film % by volume | Percentage of $Fe_3O_4$ % by volume | Reference sample | Iron loss (vs. reference sample) | Hysteresis loss (vs. reference sample) | Eddy-current loss (vs. reference sample) |
| 1-101 | 0.40 | 600 | (nitrogen) | 92.6 | 0.245 | 112.4 | 0.0 | 0.000 | 0.000 | 1-121 | not acid-treated 118% | 99% | 183% |
| | | | | | | | | | | | acid-treated 95% | 99% | 80% |

TABLE 1-continued

| Sample No. | Raw-material powder Lubricant % by mass | Heat-treatment conditions: Temperature ° C. | Heat-treatment conditions: Oxygen concentration in atmosphere % by volume | Compact: Relative density % | Compact: Surface area/volume $mm^{-1}$ | Compact: Cross-sectional perimeter mm | Coating layer (iron-based oxide film): Thickness μm | Coating layer (iron-based oxide film): Percentage of film % by volume | Coating layer (iron-based oxide film): Percentage of $Fe_3O_4$ % by volume | Reference sample | Loss: Iron loss (vs. reference sample) | Loss: Hysteresis loss (vs. reference sample) | Loss: Eddy-current loss (vs. reference sample) |
|---|---|---|---|---|---|---|---|---|---|---|---|---|---|
| 1-121 | 0.40 | 600 | 21 (air) | 92.6 | 0.245 | 112.4 | 6.1 | 0.160 | 0.085 | | 100% | 100% | 100% |
| 1-1 | 0.40 | 600 | 0.05 | 92.6 | 0.245 | 112.4 | 1.7 | 0.042 | 0.032 | | 87% | 98% | 50% |
| 1-2 | 0.40 | 600 | 5.0 | 92.6 | 0.245 | 112.4 | 4.8 | 0.119 | 0.046 | | 94% | 100% | 72% |
| 1-3 | 0.40 | 600 | 3.0 | 92.6 | 0.245 | 112.4 | 4.3 | 0.105 | 0.042 | | 94% | 100% | 72% |
| 1-4 | 0.40 | 600 | 1.0 | 92.6 | 0.245 | 112.4 | 4.0 | 0.097 | 0.037 | | 90% | 97% | 68% |
| 1-5 | 0.40 | 600 | 0.02 | 92.6 | 0.245 | 112.4 | 0.7 | 0.016 | 0.015 | | 90% | 98% | 47% |
| 1-102 | 0.40 | 600 | (nitrogen) | 92.6 | 0.338 | 111 | 0.0 | 0.000 | 0.000 | 1-122 | not acid-treated 131% | 99% | 291% |
| | | | | | | | | | | | acid-treated 91% | 97% | 59% |
| 1-122 | 0.40 | 600 | 21 (air) | 92.6 | 0.338 | 111 | 6.4 | 0.215 | 0.113 | | 100% | 100% | 100% |
| 1-6 | 0.40 | 600 | 0.05 | 92.6 | 0.338 | 111 | 1.7 | 0.057 | 0.043 | | 88% | 98% | 41% |
| 1-7 | 0.40 | 600 | 5.0 | 92.6 | 0.338 | 111 | 5.2 | 0.176 | 0.067 | | 94% | 100% | 62% |
| 1-8 | 0.40 | 600 | 3.0 | 92.6 | 0.338 | 111 | 4.8 | 0.162 | 0.065 | | 92% | 100% | 50% |
| 1-9 | 0.40 | 600 | 1.0 | 92.6 | 0.338 | 111 | 4.3 | 0.147 | 0.061 | | 90% | 98% | 50% |
| 1-10 | 0.40 | 600 | 0.02 | 92.6 | 0.338 | 111 | 0.7 | 0.024 | 0.023 | | 90% | 98% | 53% |

TABLE 2

| Sample No. | Raw-material powder Lubricant % by mass | Heat-treatment conditions: Temperature ° C. | Heat-treatment conditions: Oxygen concentration in atmosphere % by volume | Compact: Relative density % | Compact: Surface area/volume $mm^{-1}$ | Compact: Cross-sectional perimeter mm | Coating layer (iron-based oxide film): Thickness μm | Coating layer (iron-based oxide film): Percentage of film % by volume | Coating layer (iron-based oxide film): Percentage of $Fe_3O_4$ % by volume | Reference sample | Loss: Iron loss (vs. reference sample) | Loss: Hysteresis loss (vs. reference sample) | Loss: Eddy-current loss (vs. reference sample) |
|---|---|---|---|---|---|---|---|---|---|---|---|---|---|
| 1-103 | 0.40 | 600 | (nitrogen) | 92.6 | 0.464 | 44 | 0.0 | 0.000 | 0.000 | 1-123 | not acid-treated 127% | 95% | 292% |
| | | | | | | | | | | | acid-treated 89% | 96% | 57% |
| 1-123 | 0.40 | 600 | 21 (air) | 92.6 | 0.464 | 44 | 6.4 | 0.297 | 0.158 | | 100% | 100% | 100% |
| 1-11 | 0.40 | 600 | 0.05 | 92.6 | 0.464 | 44 | 1.6 | 0.074 | 0.056 | | 87% | 95% | 51% |
| 1-12 | 0.40 | 600 | 5.0 | 92.6 | 0.464 | 44 | 5.2 | 0.241 | 0.093 | | 92% | 98% | 59% |
| 1-13 | 0.40 | 600 | 3.0 | 92.6 | 0.464 | 44 | 4.6 | 0.213 | 0.086 | | 90% | 97% | 54% |
| 1-14 | 0.40 | 600 | 1.0 | 92.6 | 0.464 | 44 | 4.1 | 0.190 | 0.082 | | 89% | 97% | 49% |
| 1-15 | 0.40 | 600 | 0.02 | 92.6 | 0.464 | 44 | 0.6 | 0.028 | 0.027 | | 90% | 96% | 59% |
| 1-104 | 0.40 | 600 | (nitrogen) | 92.6 | 0.686 | 38 | 0 | 0.000 | 0.000 | 1-124 | not acid-treated 124% | 89% | 321% |
| | | | | | | | | | | | acid-treated 90% | 90% | 91% |
| 1-124 | 0.40 | 600 | 21 (air) | 92.6 | 0.686 | 38 | 6.2 | 0.436 | 0.229 | | 100% | 100% | 100% |
| 1-16 | 0.40 | 600 | 0.05 | 92.6 | 0.686 | 38 | 1.6 | 0.115 | 0.086 | | 94% | 94% | 94% |
| 1-17 | 0.40 | 600 | 5.0 | 92.6 | 0.686 | 38 | 5.3 | 0.357 | 0.136 | | 97% | 97% | 94% |
| 1-18 | 0.40 | 600 | 3.0 | 92.6 | 0.686 | 38 | 4.7 | 0.322 | 0.129 | | 96% | 97% | 91% |
| 1-19 | 0.40 | 600 | 1.0 | 92.6 | 0.686 | 38 | 4.4 | 0.298 | 0.125 | | 95% | 95% | 94% |
| 1-20 | 0.40 | 600 | 0.02 | 92.6 | 0.686 | 38 | 0.6 | 0.049 | 0.047 | | 93% | 93% | 91% |

TABLE 3

| | | Heat-treatment conditions | | | | | Coating layer (iron-based oxide film) | | | Loss | | | |
|---|---|---|---|---|---|---|---|---|---|---|---|---|---|
| | | | | Compact | | | | | | | | | |
| Sample No. | Raw-material powder Lubricant % by mass | Temperature ° C. | Oxygen concentration in atmosphere % by volume | Relative density % | Surface area/volume $mm^{-1}$ | Cross-sectional perimeter mm | Thickness μm | Percentage of film % by volume | Percentage of $Fe_3O_4$ % by volume | Reference sample | Iron loss (vs. reference sample) | Hysteresis loss (vs. reference sample) | Eddy-current loss (vs. reference sample) |
| 1-21 | 0.40 | 600 | 0.1 | 95.4 | 0.245 | 112.4 | 2.2 | 0.054 | 0.033 | 1-125 | 88% | 91% | 75% |
| 1-105 | 0.40 | 600 | (nitrogen) | 95.4 | 0.245 | 112.4 | 0.0 | 0.000 | 0.000 | | not acid-treated 132% | 93% | 291% |
| | | | | | | | | | | | acid-treated 89% | 90% | 85% |
| 1-125 | 0.40 | 600 | 21 (air) | 95.4 | 0.245 | 112.4 | 7.9 | 0.195 | 0.122 | | 100% | 100% | 100% |
| 1-22 | 0.40 | 600 | 0.1 | 98.8 | 0.245 | 112.4 | 2.1 | 0.052 | 0.032 | 1-126 | 87% | 89% | 78% |
| 1-106 | 0.40 | 600 | (nitrogen) | 98.8 | 0.245 | 112.4 | 0.0 | 0.000 | 0.000 | | not acid-treated 142% | 94% | 322% |
| | | | | | | | | | | | acid-treated 89% | 90% | 84% |
| 1-126 | 0.40 | 600 | 21 (air) | 98.8 | 0.245 | 112.4 | 7.7 | 0.190 | 0.119 | | 100% | 100% | 100% |
| 1-23 | 0.40 | 600 | 0.1 | 91.3 | 0.245 | 112.4 | 2.4 | 0.059 | 0.036 | 1-1227 | 88% | 93% | 68% |
| 1-107 | 0.40 | 600 | (nitrogen) | 91.3 | 0.245 | 112.4 | 0.0 | 0.000 | 0.000 | | not acid-treated 117% | 93% | 207% |
| | | | | | | | | | | | acid-treated 91% | 93% | 83% |
| 1-127 | 0.40 | 600 | 21 (air) | 91.3 | 0.245 | 112.4 | 8.2 | 0.202 | 0.127 | | 100% | 100% | 100% |
| 1-24 | 0.40 | 600 | 0.1 | 90.6 | 0.245 | 112.4 | 2.7 | 0.065 | 0.040 | 1-128 | 91% | 93% | 84% |
| 1-108 | 0.40 | 600 | (nitrogen) | 90.6 | 0.245 | 112.4 | 0.0 | 0.000 | 0.000 | | not acid-treated 116% | 92% | 213% |
| | | | | | | | | | | | acid-treated 92% | 93% | 88% |
| 1-128 | 0.40 | 600 | 21 (air) | 90.6 | 0.245 | 112.4 | 8.5 | 0.205 | 0.139 | | 100% | 100% | 100% |
| 1-25 | 0.40 | 600 | 0.1 | 89.8 | 0.245 | 112.4 | 3.4 | 0.083 | 0.051 | 1-129 | 102% | 100% | 97% |
| 1-109 | 0.40 | 600 | (nitrogen) | 89.8 | 0.245 | 112.4 | 0.0 | 0.000 | 0.000 | | not acid-treated 115% | 96% | 173% |
| | | | | | | | | | | | acid-treated 97% | 96% | 82% |
| 1-129 | 0.40 | 600 | 21 (air) | 89.8 | 0.245 | 112.4 | 10.5 | 0.256 | 0.192 | | 100% | 100% | 100% |
| 1-26 | 0.60 | 600 | 0.1 | 92.6 | 0.245 | 112.4 | 2.2 | 0.054 | 0.033 | 1-121 | 92% | 93% | 85% |
| 1-27 | 0.10 | 600 | 0.1 | 92.6 | 0.245 | 112.4 | 2.3 | 0.056 | 0.035 | | 93% | 94% | 85% |

TABLE 4

| Sample No. | Raw-material powder Lubricant % by mass | Heat-treatment conditions: Temperature ° C. | Heat-treatment conditions: Oxygen concentration in atmosphere % by volume | Compact: Relative density % | Compact: Surface area/volume $mm^{-1}$ | Compact: Cross-sectional perimeter mm | Coating layer (iron-based oxide film): Thickness μm | Coating layer (iron-based oxide film): Percentage of film % by volume | Coating layer (iron-based oxide film): Percentage of $Fe_3O_4$ % by volume | Reference sample | Loss: Iron loss (vs. reference sample) | Loss: Hysteresis loss (vs. reference sample) | Loss: Eddy-current loss (vs. reference sample) |
|---|---|---|---|---|---|---|---|---|---|---|---|---|---|
| 1-130 | 0.40 | 650 | 21 (air) | 92.6 | 0.338 | 111 | 9.1 | 0.308 | 0.099 | 1-130 | 100% | 100% | 100% |
| 1-28 | 0.40 | 650 | 5.0 | 92.6 | 0.338 | 111 | 7.2 | 0.243 | 0.079 | | 95% | 97% | 88% |
| 1-29 | 0.40 | 650 | 3.0 | 92.6 | 0.338 | 111 | 4.8 | 0.119 | 0.046 | | 94% | 98% | 79% |
| 1-30 | 0.40 | 650 | 1.0 | 92.6 | 0.338 | 111 | 6.3 | 0.213 | 0.058 | | 92% | 97% | 77% |
| 1-31 | 0.40 | 650 | 0.050 | 92.6 | 0.338 | 111 | 2.8 | 0.096 | 0.053 | | 91% | 95% | 77% |
| 1-110 | 0.40 | 650 | (nitrogen) | 92.6 | 0.338 | 111 | 0.0 | 0.000 | 0.000 | | not acid-treated 122% | 99% | 200% |
| | | | | | | | | | | | acid-treated 93% | 98% | 74% |
| 1-32 | 0.40 | 700 | 0.10 | 92.6 | 0.338 | 111 | 3.3 | 0.112 | 0.038 | | 90% | 93% | 79% |
| 1-33 | 0.40 | 725 | 0.10 | 92.6 | 0.338 | 111 | 3.7 | 0.125 | 0.040 | | 103% | 94% | 135% |
| 1-34 | 0.40 | 550 | 0.1 | 92.6 | 0.338 | 111 | 2.0 | 0.068 | 0.026 | 1-131 | 91% | 94% | 76% |
| 1-111 | 0.40 | 550 | (nitrogen) | 92.6 | 0.338 | 111 | 0.0 | 0.000 | 0.000 | | not acid-treated 114% | 93% | 207% |
| | | | | | | | | | | | acid-treated 92% | 94% | 83% |
| 1-131 | 0.40 | 550 | 21 (air) | 92.6 | 0.338 | 111 | 7.5 | 0.255 | 0.186 | | 100% | 100% | 100% |
| 1-35 | 0.40 | 525 | 0.1 | 92.6 | 0.338 | 111 | 4.0 | 0.152 | 0.082 | 1-132 | 100% | 100% | 100% |
| 1-112 | 0.40 | 525 | (nitrogen) | 92.6 | 0.338 | 111 | 0.0 | 0.000 | 0.000 | | not acid-treated 120% | 92% | 255% |
| | | | | | | | | | | | acid-treated 92% | 93% | 91% |
| 1-132 | 0.40 | 525 | 21 (air) | 92.6 | 0.338 | 111 | 10.7 | 0.360 | 0.296 | 1-121 | 100% | 100% | 100% |

We will focus our attention on Tables 1 and 2, and let us compare the samples having the same (surface area/volume) ($mm^{-1}$) and the same cross-sectional perimeter (mm). Tables 1 and 2 indicate that in sample Nos. 1-101 to 1-104, in which the heat treatment has been performed in the nitrogen atmosphere, unless the acid treatment is performed after the heat treatment, the iron loss is high because of, in particular, high eddy-current loss (see "not acid-treated"), and that by performing the acid treatment after the heat treatment, the eddy-current loss can be reduced to reduce the iron loss (see "acid-treated"). However, because the acid treatment is required in addition to the heat treatment, the number of steps is large. When masking is performed, the number of steps is further increased.

As described in Tables 1 and 2, in sample Nos. 1-121 to 1-124, in which the heat treatment has been performed in the air atmosphere, although the samples have lower eddy-current loss and lower iron loss than sample Nos. 1-101 (not acid-treated) to 1-104 (not acid-treated), the samples tend to have higher eddy-current loss than sample Nos. 1-101 (acid-treated) to 1-104 (acid-treated); thus, the iron loss is not sufficiently low. Sample Nos. 1-121 to 1-124 tend to have higher hysteresis loss than sample Nos. 1-101 to 1-104. When the (surface area/volume) is higher, this tendency is more noticeable. The reasons for these are presumably that, for example, sample Nos. 1-121 to 1-124 have excessive contents of $Fe_3O_4$, in particular, a higher value of the (surface area/volume) results in a larger absolute amount of $Fe_3O_4$.

As described in Tables 1 and 2, in contrast, sample Nos. 1-1 to 1-20, which contain $Fe_3O_4$ on the surfaces of the compacts, tend to have particularly lower eddy-current loss and lower hysteresis loss than sample Nos. 1-121 to 1-124, in which the heat treatment has been performed in the air atmosphere; thus, the iron loss is low.

The reason for this is presumably that sample Nos. 1-1 to 1-20 have lower contents of $Fe_3O_4$ than sample Nos. 1-121 to 1-124. Specifically, when the (surface area/volume) is 0.40 $mm^{-1}$ or less, the content of $Fe_3O_4$ is 0.08% or less by volume (in this example, even 0.07% or less by volume). When the (surface area/volume) is more than 0.40 $mm^{-1}$ and 0.60 $mm^{-1}$ or less, the content of $Fe_3O_4$ is 0.12% or less by volume (in this example, even 0.10% or less by volume). When the (surface area/volume) is more than 0.60, the content of $Fe_3O_4$ is 0.15% or less by volume (in this example, even 0.14% or less by volume).

One of the reasons for the low eddy-current loss is presumably that sample Nos. 1-1 to 1-20 include the iron-based oxide films having better insulation than the iron-based particles 7 and thus have high insulation between the iron-based particles 7 even if the insulating coatings 8 are damaged in the production process and that, in addition, the samples have lower contents of $Fe_3O_4$, which has a relatively low resistivity, than sample Nos. 1-121 to 1-124. Another reason for this is presumably that even when the resistivity of the iron-based oxide film is substantially equal to that of sample Nos. 1-121 to 1-124 and does not vary, in this example, the iron-based oxide film of each of sample Nos. 1-1 to 1-20 has a smaller thickness than sample Nos. 1-121 to 1-124, so that an eddy current did not easily flow through the iron-based oxide film itself, i.e., the electrical resistance was increased. In particular, in the case where the cross-sectional perimeter L is 40 mm or more and where the (surface area/volume) is 0.6 $mm^{-1}$ or less (sample Nos. 1-1 to 1-15) or 0.40 $mm^{-1}$ or less (sample Nos. 1-1 to 1-10), the effect of reducing the eddy-current loss tends to be higher than that of sample Nos. 1-121 to 1-124. The reasons for this are presumably that the longer cross-sectional perimeter results in a longer eddy-current loop and that although the samples are susceptible to the effect of $Fe_3O_4$ because of their small values of the (surface area/volume), sample Nos. 1-1 to 1-15 have sufficiently low contents of $Fe_3O_4$, and sample Nos. 1-1 to 1-10 have lower contents of $Fe_3O_4$.

One of the reasons for the low hysteresis loss is presumably that sample Nos. 1-1 to 1-20 have lower contents of $Fe_3O_4$, which is a ferromagnetic material and has a higher coercive force than pure iron, than sample Nos. 1-121 to 1-124. In particular, in the case where the (surface area/volume) is more than 0.60 $mm^{-1}$ (sample Nos. 1-16 to 1-20), the effect of reducing the hysteresis loss tends to be high. In sample No. 1-124, in which the (surface area/volume) is high, the absolute amount of $Fe_3O_4$ is easily increased; thus, the effect of $Fe_3O_4$, which is a ferromagnetic material and has a high coercive force, is easily increased to increase the hysteresis loss. In contrast, in sample Nos. 1-16 to 1-20, the absolute amounts of $Fe_3O_4$ are smaller than that of sample No. 1-124. Some samples have a content of $Fe_3O_4$ of 60% or less or less than 40% of the content of $Fe_3O_4$ in sample No. 1-124. Thus, the effect of reducing the hysteresis loss seems to be easily provided. Because sample Nos. 1-16 to 1-20 of this example have a relatively short cross-sectional perimeter (here, 40 mm or less), there is not so large difference in eddy-current loss with respect to sample No. 1-124.

It is found that the compacts of sample Nos. 1-1 to 1-20 that can provide the low-loss magnetic cores are formed by compacting the raw-material powder including the coated soft-magnetic powder and the specific lubricant and then subjecting the green compacts to the heat treatment in the specific low-oxygen atmosphere. In particular, it is found that a lower oxygen concentration in the atmosphere (in this example, less than 5.0% by volume, even 3.0% or less by volume, particularly less than 1.0% by volume) results in a lower content of $Fe_3O_4$, thus easily reducing the eddy-current loss. In this example, the eddy-current loss is easily reduced at a content of $Fe_3O_4$ of 0.065% or less by volume, 0.05% or less by volume, even 0.045% or less by volume, particularly 0.035% or less by volume when the (surface area/volume) is 0.40 $mm^{-1}$ or less; at a content of $Fe_3O_4$ of 0.09% or less by volume, even 0.085% or less by volume, particularly 0.07% or less by volume when the (surface area/volume) is more than 0.40 $mm^{-1}$ and 0.60 $mm^{-1}$ or less; and at a content of $Fe_3O_4$ of 0.14% or less by volume, even 0.13% or less by volume, particularly 0.12% or less by volume when the (surface area/volume) is more than 0.60.

Among sample Nos. 1-1 to 1-20, some samples having a cross-sectional perimeter of 40 mm or more and a value of the (surface area/volume) of 0.6 $mm^{-1}$ or less have lower eddy-current loss and lower hysteresis loss than sample Nos. 1-101 (acid-treated) to 1-104 (acid-treated). In particular, sample Nos. 1-1 to 1-6 and 1-8 to 1-10 having a cross-sectional perimeter of 40 mm or more and a (surface area/volume) value of 0.40 $mm^{-1}$ or less have sufficiently lower eddy-current loss and lower iron loss than sample Nos. 1-101 (acid-treated) and 1-102 (acid-treated). Thus, in particular, when the compacts having a magnetic path cross section with a long cross-sectional perimeter of 40 mm or more and, particularly, having a value of the (surface area/volume) of 0.40 $mm^{-1}$ or less have a specific content of $Fe_3O_4$, the effect of reducing the eddy-current loss is sufficiently provided. Accordingly, the low-loss magnetic cores having loss comparable to or preferably lower than the case of performing the acid treatment can be formed without performing the acid treatment after the heat treatment in the nitrogen atmosphere.

Next, we will focus our attention on Table 3, and let us compare the samples having the same relative density (%). As described in Table 3, sample Nos. 1-21 and 1-22 having a relatively high relative density have lower iron loss than sample No. 1-105 (acid-treated) and 1-106 (acid-treated). Sample Nos. 1-23 to 1-25 having a relatively low relative density have lower iron loss than sample Nos. 1-107 (not acid-treated) to 1-109 (not acid-treated), and a higher relative density results in lower iron loss. In particular, sample Nos. 1-21 to 1-24 having a relative density of 90.0% or more (here, even 90.5% or more) have lower iron loss than sample Nos. 1-125 to 1-128, in which the heat treatment has been performed in the air atmosphere, and sample Nos. 1-105 (acid-treated) to 1-108 (acid-treated). The reason for this is presumably that because of the high relative density to some extent, the internal oxidation of the green compacts during the heat treatment does not easily proceed, thus inhibiting an excessive content of $Fe_3O_4$ (here, 0.05% or less by volume). In sample No. 1-25 having a low relative density, the internal oxidation proceeds during the heat treatment to result in a higher content of $Fe_3O_4$ than that of sample No. 1-24, thereby seemingly easily increasing the eddy-current loss and the hysteresis loss.

As described in Table 3, sample Nos. 1-26 and 1-27, in which the content of the lubricant in the raw-material powder is 0.10% or more by mass, have lower iron loss than sample Nos. 1-121 and 1-101 (acid-treated, see Table 1). A possible reason for this is as follows: Because a certain amount of the lubricant is contained in the raw-material powder, the green compacts also contain a certain amount of the lubricant. Although the lubricant is removed with increasing temperature during the heat treatment, the incorporation of the certain amount of the lubricant inhibits the internal oxidation of the green compacts to inhibit an excessive incorporation of $Fe_3O_4$.

Next, we will focus our attention on Table 4, and the effect of the heat-treatment temperature will be described. As described in Table 4, a higher heat-treatment temperature results in lower hysteresis loss. Specifically, it is found that a higher temperature results in lower hysteresis loss in sample Nos. 1-28 to 1-35, in which the heat-treatment temperature is higher than 520° C., compared with sample Nos. 1-130 to 1-132, in which the heat treatment has been performed in the air atmosphere. In particular, sample Nos. 1-28 to 1-32, in which the heat-treatment temperature is higher than 550° C. and 700° C. or lower, have lower iron loss (absolute value) than sample No. 1-102 (acid-treated, see Table 1). Some samples have lower iron loss than sample No. 1-110 (acid-treated), in which the heat treatment has been performed at the same temperature. A possible reason for this is as follows: Although the internal oxidation of the green compacts proceeds in the course of the temperature increase during the heat treatment, a high temperature to some extent allows an inner oxide to disappear, so that the oxide is left only on the surface. As a result, the iron-based oxide film can be appropriately included. In sample Nos. 1-34 and 1-35, in which the heat-treatment temperature is 550° C. or lower, which is relatively low, unlike the foregoing case, the inner oxide cannot disappear, and a large amount of the oxide is left. For this reason, the eddy-current loss and the hysteresis loss seem to be easily increased, compared with the samples in which the heat-treatment temperature is high. Sample No. 1-33, in which the heat-treatment temperature is higher than 700° C., has low hysteresis loss but high eddy-current loss. The reason for this is presumably that the insulating coatings 8 are thermally damaged because of the high temperature. From this test, the heat-treatment temperature is preferably higher than 520° C. and 700° C. or lower, even higher than 550° C. and 700° C. or lower.

The embodiments disclosed herein are to be considered in all respects as illustrative and not limiting. The scope of the invention is defined not by the foregoing description but by the following claims, and is intended to include any modifications within the scope and meaning equivalent to the scope of the claims. For example, the composition and the particle size of the iron-based particles, the composition and the thickness of the insulating coating, the size of the raw-material powder, and the density of the compact described in the test examples can be appropriately changed.

REFERENCE SIGNS LIST

1 electromagnetic component
2 coil
2*w* wound wire
2*a*, 2*b* wound portion
2*r* connecting portion
3 magnetic core
7 iron-based particle
8 insulating coating
9 coated soft-magnetic particle
10 compact
13 iron-based oxide film
31 inner core portion
31*m* core piece
31*g* gap material
32 outer core portion (core piece)
$S_{10}$ magnetic path cross section
L cross-sectional perimeter

The invention claimed is:

1. A compact comprising coated soft-magnetic particles collected, the coated soft-magnetic particles including iron-based particles and insulating coatings that cover surfaces of the iron-based particles, wherein when the compact is used for a magnetic core, a magnetic path cross section has a cross-sectional perimeter of more than 20 mm, at least part of a surface of the compact is covered with an iron-based oxide film having an average thickness of 0.5 μm or more and 10.0 μm or less, and at least part of the iron-based oxide film is formed on the insulating coatings, and letting the proportion of a surface area of the compact to a volume of the compact be surface area/volume, a content of $Fe_3O_4$ present in the iron-based oxide film with respect to 100% by volume of the compact satisfies any one of (1) to (3):

(1) the content of $Fe_3O_4$ is more than 0% and less than 0.085% by volume when the (surface area/volume) is 0.40 $mm^{-1}$ or less;

(2) the content of $Fe_3O_4$ is more than 0% and 0.12% or less by volume when the (surface area/volume) is more than 0.40 $mm^{-1}$ and 0.60 $mm^{-1}$ or less; and (3) the content of $Fe_3O_4$ is more than 0% and 0.15% or less by volume when the (surface area/volume) is more than 0.60 $mm^{-1}$.

2. The compact according to claim 1, wherein the cross-sectional perimeter is 40 mm or more, and the (surface area/volume) is 0.60 $mm^{-1}$ or less.

3. The compact according to claim 1, wherein the surface of the compact is entirely covered with the iron-based oxide film, the iron-based oxide film has a thickness of 0.5 μm or more and 10.0 μm or less at any point.

4. The compact according to claim 1, wherein the compact has a relative density of 90.0% or more and 99.0% or less.

5. An electromagnetic component comprising a coil and a magnetic core on which the coil is arranged, wherein at least part of the magnetic core includes the compact according to claim 1.

6. The compact according to claim 1, wherein at least part of the iron-based oxide film is formed on each side of the insulating coatings.

7. A method for producing the compact according to claim 1, comprising the steps of:

compacting a raw-material powder including the coated soft-magnetic powder and a lubricant to form a green compact; and heat-treating the green compact to form the compact, wherein the lubricant contains a component having a decomposition onset temperature of 170° C. or higher, a content of the lubricant is 0.10% or more by mass and 0.60% or less by mass based on 100% by mass of the raw-material powder, and conditions of the heat treatment include an oxygen concentration in an atmosphere of 0.01% or more by volume and 5.0% or less by volume and a temperature of higher than 520° C. and 700° C. or lower.

* * * * *